US008282244B2

(12) United States Patent
Römelt

(10) Patent No.: US 8,282,244 B2
(45) Date of Patent: Oct. 9, 2012

(54) FOCUSING COLOR LED EMITTER

(75) Inventor: Heiko Römelt, Menden (DE)

(73) Assignee: Bega Gantenbrink-Leuchten KG, Menden (DE)

( * ) Notice: Subject to any disclaimer, the term of this patent is extended or adjusted under 35 U.S.C. 154(b) by 305 days.

(21) Appl. No.: 12/540,042

(22) Filed: Oct. 5, 2009

(65) Prior Publication Data

US 2010/0039805 A1 Feb. 18, 2010

(30) Foreign Application Priority Data

Aug. 12, 2008 (DE) ..... 10 2008 038 778

(51) Int. Cl.
*F21S 4/00* (2006.01)
*F21V 21/00* (2006.01)

(52) U.S. Cl. ..... 362/249.06; 362/800

(58) Field of Classification Search ..... 362/249.02, 362/249.06, 311.02, 545, 555, 612, 800; 349/69

See application file for complete search history.

(56) References Cited

U.S. PATENT DOCUMENTS 6,200,002 B1 3/2001 Marshall et al.
7,806,558 B2 * 10/2010 Williamson ..... 362/241
2006/0023461 A1 2/2006 Knight
2006/0226336 A1 * 10/2006 York et al. ..... 250/206
2008/0123057 A1 5/2008 Williamson

FOREIGN PATENT DOCUMENTS

| | | | |
|---|---|---|---|
| CN | 1529914 | A1 | 9/2004 |
| DE | 600 34 405 | T2 | 1/2008 |
| JP | 08030213 | A | 2/1996 |
| WO | 2007008048 | A1 | 1/2007 |
| WO | 2008010130 | A2 | 1/2008 |

* cited by examiner

*Primary Examiner* — Jason Moon Han

(74) *Attorney, Agent, or Firm* — Baker & Hostetler LLP

(57) ABSTRACT

In a color-selectively dimmable and focusing LED emitter comprising a plurality of different-colored LEDs arranged, on a support element, as a plurality of similar LED tuples, each of the LED tuples comprising at least two different-colored LEDs, each LED tuple having assigned thereto a separate reflector, and each of the LED tuples being rotated about the optical axis of the associated reflector relative to a neighboring LED tuple. Improved color mixing is achieved together with high efficiency and good focusing in that the LED-emitter comprises more than four LED tuples and each of the LED tuples is rotated about the optical axis of the associated reflector relative to a preceding neighboring LED tuple by a respective angle $\phi$, the angle $\phi$ being calculated as 360° divided by the number of the LED tuples.

9 Claims, 1 Drawing Sheet

FOCUSING COLOR LED EMITTER

CROSS-REFERENCE TO RELATED APPLICATIONS

This nonprovisional application claims priority to foreign Patent Application DE 10 2008 038 778.9, filed on Aug. 12, 2008, the disclosure of which is incorporated herein by reference in its entirety.

FIELD OF THE INVENTION

The present invention relates to an LED emitter. More particularly, the present invention relates to a focusing LED emitter with a plurality of different-colored LEDs.

BACKGROUND OF THE INVENTION

LED emitters for generating colored light generally employ the principle of additive color mixing. For this purpose LEDs are normally used that emit the primary colors red, green and blue and can be regulated in their intensity. This method is called RGB method. To improve the color quality, pastel-colored LEDs are also now used for color mixing apart from white or amber LEDs.

The individual color components can be mixed inside or outside the LED emitter. An internal mixing is accomplished, for example, by diffusion by means of diffusing lenses. In the case of external color mixing, collimators or reflectors are used for suitably varying the optical path of the different-colored LEDs, resulting in a superposition of the individual color components on the illuminated object.

Commercially available LED emitters for generating different-colored light are mostly equipped with one reflector only, and are provided with a multitude of different-colored and irregularly arranged LEDs.

A diode lamp with a plurality of different-colored LEDs for readjusting the color temperature is known from DE 600 34 405. A reflecting tube is used for mixing light. The different-colored LEDs are arranged in a matrix in the entrance aperture of the reflecting tube. To mix the individual color components with one another, different geometric shapes of the reflecting tube and different arrangements of the different-colored LEDs within the matrix are suggested.

The main problem of the LED emitters known from the prior art and used for generating different-colored light is that good focusing, high efficiency and good color mixing are incompatible. For instance, systems with internal color mixing by diffusion, for instance by means of diffusers, exhibit poor efficiency and a diffuse and broad emission characteristic. In systems with external color mixing, good focusing properties and high degrees of efficiency are achieved, but color mixing is poor. The diode luminaire known from DE 600 34 405 can be regarded as a compromise. In this instance, too, it is not possible to achieve optimum results in terms of focusing, efficiency and light mixing.

Moreover, the use of modern high-power LEDs necessitates at least passive cooling. As a consequence, when high-power LEDs are used, a standard arrangement of any desired number of irregularly-distributed, closely-spaced, different-colored LEDs in the center of a single reflector, for producing a luminous emitter with acceptable light mixing, is not possible.

WO 2008/010130 A2 shows a composite light source for generating light of a predetermined color. The light source has a plurality of sub-modules which are each able to generate light of that predetermined color. Each sub-module has a light collimating and mixing structure and a light unit group consisting of a plurality of colored LEDs which are arranged at an entrance of the collimating and mixing structure. If, for example, each of four light unit groups comprises four different-colored LEDs arranged in a square array, it is suggested that the LEDs of a sub-module are rotated clockwise or counterclockwise within the array, as compared to a neighboring preceding sub-module, in order to achieve a homogenizing interaction of the light emitted from the sub-modules. Thus, four different arrangements of the LEDs are possible. The rotating pattern is simply repeated if the light source consists of more than four sub-modules.

A disadvantage of the light source described in WO 2008/010130 A2 is that, although better mixing of the light emitted from the sub-modules is achieved by means of the rotated arrangement of the light unit groups, areas of slightly different colored shades can still be observed on a lighted object. This inhomogeneous effect is intensified if the light source comprises more than four sub-modules for a higher light intensity, and the rotating pattern is repeated.

SUMMARY OF THE INVENTION

Embodiments of the present invention advantageously provide a focusing high intensity LED emitter which is distinguished by high efficiency and improved color mixing and can be of a simple design. Furthermore, the problems known from the prior art should be overcome.

It should be noted that the invention can also be applied to emitter-like luminaires such as spotlights.

Embodiments of the present invention advantageously provide an LED emitter, and, more particularly, a color-selectively dimmable LED emitter comprising a plurality of different-colored LEDs arranged on a support element, in which the LEDs are arranged in a plurality of similar LED tuples with each of the LED tuples comprising at least two different-colored LEDs with a separate reflector being assigned to each LED tuple, the LED-emitter comprises more than four LED tuples, and each of the LED tuples is rotated about the optical axis of the associated reflector relative to a preceding neighboring LED tuple by a respective angle $\phi$, the angle $\phi$ being calculated as 360° divided by the number of the LED tuples.

Owing to the arrangement of a few different-colored LEDs to form an LED tuple with associated reflector, the efficiency of the LED emitter is very high because the LEDs are directly visible and thus, in contrast to the use of diffusers, the light can be focused onto the object to be illuminated and there are low losses due to absorption and diffusion. The LED tuples can be prefabricated very easily which considerably simplifies the construction of the LED emitter in comparison with commercially available devices having a very great number of closely adjacent LEDs. Moreover, the use of already prefabricated and connectable LED tuples, so-called RGB LED elements, is possible. In general, such RGB LED elements are each made up of a red LED, a green LED, a blue LED and optionally of an additional white or amber LED and are nowadays also offered equipped with modern high-power LEDs. As a rule, high-power LEDs must be cooled at least passively in a suitable way. To discharge the emitted heat in an efficient way, it is normally enough when the number of LEDs arranged closely side by side is small. That is why the claimed arrangement of the LED tuples with individual associated reflectors is of particular advantage.

Optimal color mixing is given if each of the LED tuples is rotated about the optical axis of the associated reflector relative to a preceding neighboring LED tuple by a constant angle, said angle being calculated as 360° divided by the number of the LED tuples. Prior art light sources consist of LED-tuples that are rotated according to a recurring rotating pattern. Thus, areas where the color component of one of the different-colored LEDs prevails are summed up on the illuminated object. It is only with the claimed rotation of the LED tuples relative to one another that the areas of color accumulation are superposed such that at best they completely cancel one another resulting in an optimal color mixing of the emitted light.

In a preferred embodiment of the present invention, each of the LED tuples contains an LED in the primary colors red, green and blue. Color-selective dimming thereby enables RGB color mixing and thus the generation of light of any desired color shade.

In a further preferred embodiment of the present invention each of the LED tuples contains a white LED in addition to the three LEDs in the primary colors red, green and blue. This can improve the quality of the generated colored light.

It has turned out to be of particular advantage to color mixing when the LED tuples rotated relative to one another are arranged along an imaginary spiral on the support element.

Preferably the LED emitter comprises more than 8 LED tuples. Very good color mixing can be achieved if the LED emitter comprises 10 LED tuples.

BRIEF DESCRIPTION OF THE DRAWINGS

A preferred embodiment of the present invention will now be explained in more detail with reference to the drawings, in which.

DETAILED DESCRIPTION

Figure 1:
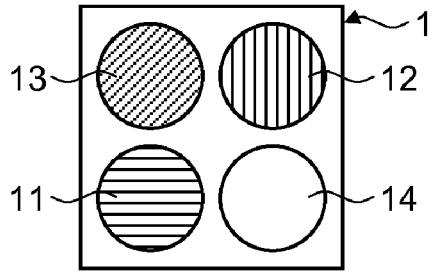
FIG. 1 shows an LED tuple with a schematic arrangement of four different-colored LEDs.

The LED tuple shown in FIG. 1 is provided with reference numeral 1. For the generation of different-colored light in all shades the LED tuple 1 has arranged thereon LEDs in the three primary colors and thus a red LED 11, a green LED 12 and a blue LED 13. The desired light color is here achieved by dimming the individual LEDs. To enhance the quality of the generated colored light, a white LED 14 is additionally arranged in the LED tuple 1. Particularly pastel-colored light can thereby be generated with better quality. While the illustrated array represents a preferred variant of the LED tuple, it is also possible to arrange a greater or smaller number of different-colored LEDs to obtain a tuple. It is also conceivable to arrange not only exclusively different-colored LEDs in one LED tuple. For instance, apart from a plurality of different-colored LEDs, two identical, e.g. white, LEDs may be contained in the LED tuple.

Figure 2:
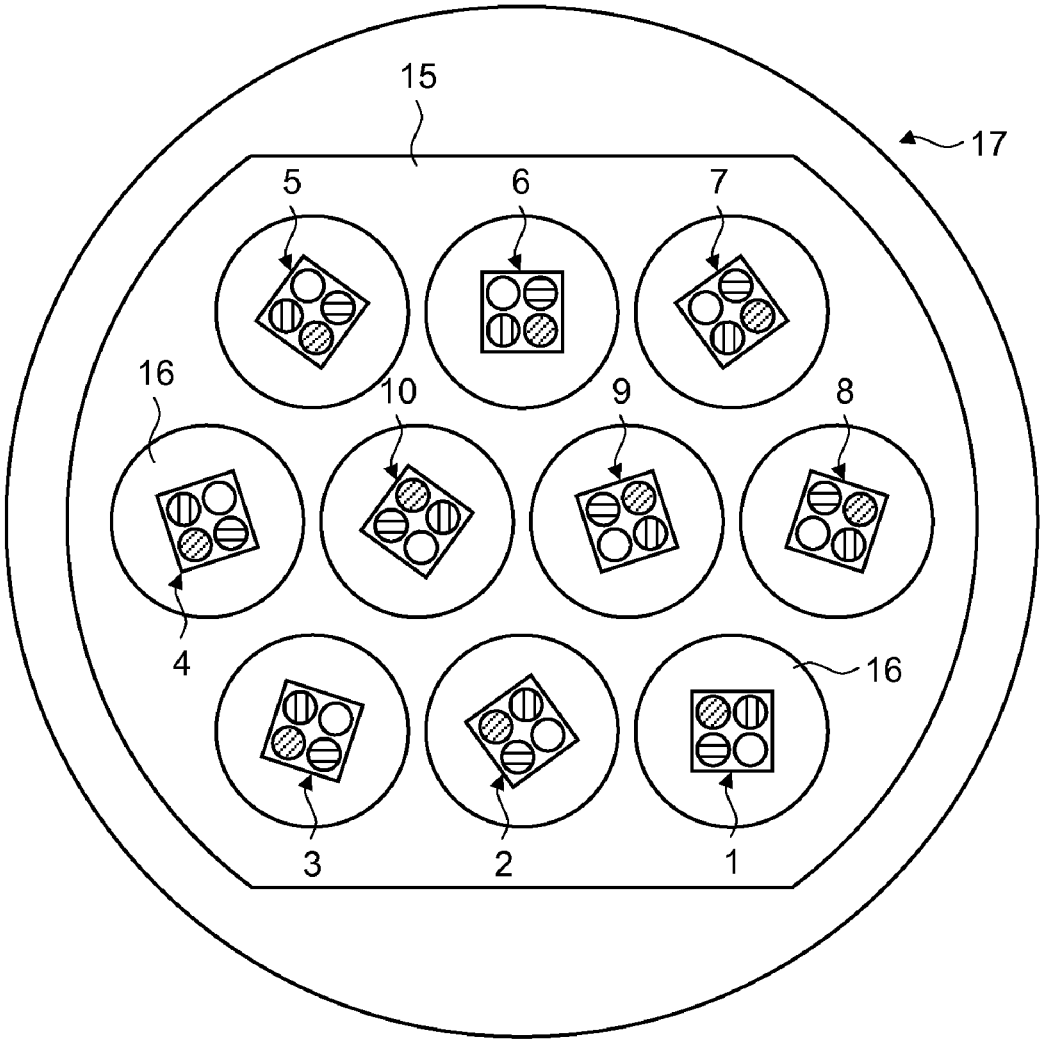
FIG. 2 is a front view of an LED emitter, according to an embodiment of the present invention, with a plurality of LED tuples arranged on a joint support element.

FIG. 2 is a front view of an LED emitter 17 according to the invention. A plurality of LED tuples 1 to 10, which in their structure correspond to the LED tuple 1 as shown in FIG. 1, are arranged on a joint support element 15. A collimator or reflector 16 is assigned to each of the LED tuples 1 to 10. It should be noted that for lack of space only the reflectors assigned to the LED tuples 1 and 4 are provided with reference numeral 16. The light emitted by one of the LED tuples 1 to 10 is focused by the respectively assigned reflector 16. All of the reflectors 16 are here oriented such that the optical paths of the LED tuples 1 to 10 are superimposed on one another on the illuminated object. The LED tuples 1 to 10 are spirally arranged on the support element 15. The ascending reference numerals of the LED tuples 1 to 10 designate the route of the imaginary spiral. Each of the LED tuples 1 to 10 is rotated counterclockwise about the axis of the respectively assigned reflector 16 relative to a preceding neighboring LED tuple 1 to 10 by an angle of 36°. The rotational angle of 36° is here obtained by division of a full circle of 360° by the number of the LED tuples 1 to 10. Hence, the LED tuple 1 is also rotated counterclockwise relative to the last LED tuple 10 of the spiral by 36°. With the illustrated arrangement of the LED tuples 1 to 10 according to a clockwise completing spiral and with the counterclockwise rotation of the LED tuples 1 to 10 relative to the respectively preceding neighboring LED tuples 1 to 10, an optimal light mixing is achieved together with high efficiency and excellent focusing.

It should be noted that the present arrangement and grouping of a small number of LEDs to form an LED tuple 1 to 10 also enables the use of modern high-power LEDs, which requires a certain distance of the LED tuples 1 to 10 from one another for cooling the LEDs.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A focusing light emitting diode (LED) emitter, comprising:

more than four similar LED tuples arranged along a spiral path on a support element, each LED tuple having at least two different-colored LEDs, and a plurality of reflectors, each reflector having an optical axis, wherein each of the LED tuples is assigned a separate reflector of the plurality of reflectors, wherein each successive LED tuple along the spiral path of more than four similar LED tuples is rotated about the optical axis of the associated reflector by an angle $\phi$ relative to a rotational position of a preceding neighboring LED tuple about the optical axis of the associated reflector of the preceding neighboring LED tuple along the spiral path, the angle $\phi$ being calculated as 360° divided by the number of the LED tuples, and wherein the LED emitter is dimmable in a color-selective way.

2. The LED emitter according to claim 1, wherein each of the LED tuples comprises a red LED, a green LED, and a blue LED.

3. The LED emitter according to claim 2, wherein each of the LED tuples comprises a white LED.

4. The LED emitter according to claim 1, wherein the LED emitter comprises more than 8 LED tuples.

5. The LED emitter according to claim 2, wherein the LED emitter comprises more than 8 LED tuples.

6. The LED emitter according to claim 3, wherein the LED emitter comprises more than 8 LED tuples.

7. The LED emitter according to claim 4, wherein the LED emitter comprises 10 LED tuples.

8. The LED emitter according to claim 5, wherein the LED emitter comprises 10 LED tuples.

9. The LED emitter according to claim 6, wherein the LED emitter comprises 10 LED tuples.

* * * * *